US005454542A

United States Patent [19]

Hart

[11] Patent Number: 5,454,542

[45] Date of Patent: Oct. 3, 1995

[54] APPARATUS AND METHODS FOR HANGING FRAMES

[76] Inventor: Hoyt E. Hart, 9740 Colonial Cir., NE., Albuquerque, N.M. 87111

[21] Appl. No.: 229,814

[22] Filed: Apr. 19, 1994

Related U.S. Application Data

[63] Continuation-in-part of Ser. No. 904,000, Jun. 24, 1992, Pat. No. 5,303,895, which is a continuation-in-part of Ser. No. 822,061, Jan. 14, 1992, Pat. No. 5,209,449.

[51] Int. Cl.[6] ..... A47G 1/16

[52] U.S. Cl. ..... 248/494; 248/547

[58] Field of Search ..... 248/494, 544, 248/475.1, 466, 489, 495, 542, 547; 40/152.1; D10/62

[56] References Cited

U.S. PATENT DOCUMENTS

| | | | |
|---|---|---|---|
| D. 282,054 | 1/1986 | Hoffman | D10/62 |
| 1,340,711 | 5/1920 | Greenwald | 248/489 |
| 2,075,588 | 3/1937 | Meyers | 248/489 X |
| 2,450,465 | 10/1948 | Bratburd | 248/494 X |
| 2,643,840 | 6/1953 | Lanman | 248/494 |
| 2,879,018 | 3/1959 | Pence | 248/494 |
| 3,552,708 | 1/1971 | Hillstrom | 248/498 |
| 3,668,798 | 6/1972 | Mehl | 248/494 X |
| 3,955,790 | 5/1976 | Ballin | 248/489 |
| 4,220,309 | 9/1980 | Eisen et al. | 248/542 |
| 4,228,982 | 10/1980 | Sellera | 248/467 |
| 4,437,639 | 3/1984 | Stein | 248/558 |
| 4,458,873 | 7/1984 | Sutherland | 248/544 |
| 4,530,482 | 7/1985 | Berinson | 248/475.1 |
| 4,531,315 | 7/1985 | Sobel | 40/155 |
| 4,582,288 | 4/1986 | Ruehl | 248/547 |
| 4,597,554 | 7/1986 | James | 248/542 |
| 4,606,526 | 8/1986 | Rabinowitz | 248/489 |
| 4,712,761 | 12/1987 | Wassell | 248/475.1 |
| 4,804,161 | 2/1989 | Wallo | 248/544 |
| 4,883,247 | 11/1989 | Crandall | 248/495 X |
| 5,080,317 | 1/1992 | Letizia | 248/544 |
| 5,178,355 | 1/1993 | Herzig | 248/493 X |

FOREIGN PATENT DOCUMENTS

| | | | |
|---|---|---|---|
| 316353 | 10/1956 | Switzerland | 248/494 |
| 384616 | 12/1932 | United Kingdom | 248/494 |
| 1031208 | 6/1966 | United Kingdom . | |

OTHER PUBLICATIONS

Advertisement, WallBuddies TM, Picture Perfect, Sioux Falls, S.D., *Picture Framing Magazine,* p. 43, (Jun. 1991).

Advertisement, PicTabs TM, LorLor TM, LorLor Corporation, Morton Grove, Ill., *Picture Framing Magazine,* p. 79, (Sep. 1991).

Advertisement, H–Hanger, Lion, Birmingham, England, *Decor Services* (Annual), p. 498, (1991–1992).

Advertisement, Record Art Gallery Rods, S&W Framing Supplies, Inc., Garden City Park, N.Y., *Decor,* p. 180, (Nov. 1991).

Advertisement, Arakawa Hanging Systems International, Portland, Ore., *Picture Framing Magazine,* p. 8, (Nov. 1991).

Advertisement, Starlight Industries, Inc., Brooklyn, N.Y., 11201, *Picture Framing Magazine,* p. 65, (Jul. 1991).

Advertisement, De Luxe "Floreat" Hangers, Ziabicki Import Company, Racine, Wis., *Picture Framing Magazine,* p. 100 (Sep. 1991) (Jul. 1991).

*Primary Examiner*—J. Franklin Foss

*Attorney, Agent, or Firm*—Deborah A. Peacock; Rod D. Baker

[57] ABSTRACT

The invention concerns apparatuses and methods for hanging frames upon mounting surfaces. The principal apparatus of the invention, upon which a frame is hung, is securely attached to a mounting surface, such as a wall. The apparatus comprises a generally planar body with a protruding supporting rail, alignment notches, spirit level, bracket recess, and mounting holes, and is particularly well suited for use with metal frames with universal assembly channels. The supporting rail of the apparatus is designed to be inserted within universal assembly channels in metal frames, thus securely yet slidably and removably attaching the apparatus to the frame. The invention also includes an adapter bracket to allow the principal apparatus to be used with any kind of frame, and special corner brackets to allow the use of the principal apparatus with unusually heavy or wide frames.

14 Claims, 7 Drawing Sheets

APPARATUS AND METHODS FOR HANGING FRAMES

CROSS-REFERENCE TO RELATED APPLICATIONS

This application is a continuation-in-part application of U.S. patent application Ser. No. 07/904,000, now U.S. Pat. No. 5,303,895, entitled "Apparatuses and Methods for Hanging Frames" to Hart, filed on Jun. 24, 1992, which is a continuation-in-part application of U.S. patent application Ser. No. 07/822,061, entitled "Apparatuses and Methods for Hanging Frames" to Hart, filed on Jan. 14, 1992 and now issued as U.S. Pat. No. 5,209,449, the teachings all of which are incorporated herein by reference.

BACKGROUND OF THE INVENTION

1. Field of the Invention (Technical Field)

The invention relates to apparatuses for hanging frames upon surfaces, and methods for their use.

2. Background Art

Despite some variety of efforts to overcome the problem, there remains a need for an improved means for hanging framed works, one that assures that the work will hang securely in a level position. The present invention fills the need by providing a simple, inexpensive, and easy-to-use apparatus and method that permit the user quickly and securely to hang a frame upon a wall or other vertical surface. Practicing the present invention, the user can consistently hang a frame on the level, with the top and bottom edges of the frame in a pleasantly horizontal aspect.

British Patent No. 1,031,208 to Chan discloses a picture-hanging apparatus comprising a supporting member to be attached to a wall and a second separate member, to be attached to the back of a picture frame, for engagement with the supporting member. The invention disclosed in the '208 Patent requires that a particular customized element be attached to the frame to be hung.

U.S. Pat. No. 4,228,982 to Sellera discloses an apparatus similar to the apparatus of the above-mentioned British patent to Chan. The '982 patent discloses an apparatus composed of two separate elements: one element to be attached to a wall, and the other specially adapted companionate element necessarily attached to the frame to be hung.

U.S. Pat. No. 4,530,482 to Berinson discloses an apparatus for hanging framed pictures consisting of a lengthy resinous strip to be attached to the wall and picture mounts with sharp edges to be attached to picture frames. The sharp edges of the picture mounts are then inserted between the strip and wall to hang picture frames. The apparatus necessarily includes a specially adapted element to be attached to the frame to be hung.

U.S. Pat. No. 4,597,554 to James also describes an apparatus consisting of a matched pair of fixture members, one of which must be attached to the picture frame.

U.S. Pat. No. 4,606,526 to Rabinowitz discloses a picture frame hanging apparatus consisting of a single block having hanger projections extending laterally along at least two sides thereof for engagement with the frame to be hung.

U.S. Pat. No. 4,804,161 to Wallo describes an apparatus consisting of a base bar of substantial width having upwardly projecting prongs at opposite ends thereof which are adapted to engage a downwardly facing surface of the top moulding of a frame. The apparatus includes a horizontally elongate fastener hole and a vertically elongate fastener hole for consecutive adjustment of the horizontal and vertical position of the apparatus. The apparatus does not provide a locking mechanism for accidental dislocation.

U.S. Pat. No. 3,955,790 to Ballin discloses a three-part apparatus consisting of a pronged base plate to be mounted to a wall, a plumb member, and a coupling member to be mounted upon a frame. The plumb member swingably rests upon a fulcrum element of the base plate to indicate when the base plate is level. The base plate may be successfully used only in conjunction with the frame-mounted coupling member, which is shaped to interlock with the base plate.

U.S. Pat. No. 4,582,288 to Ruehl describes a device for securing cables or wires to a support surface, and discloses a means for pre-driving the securing pins in a manner to allow mounting to fragile surfaces.

U.S. Pat. No. 4,712,761 to Wassell discloses a picture frame corner bracket consisting primarily of a downwardly extending corner flange for engagement with a trough extending the length of an elongated wall-mounted strip.

U.S. Pat. No. 4,437,639 to Stein describes a self-adjusting picture hanger apparatus consisting of a wall-mounted member linked to a frame mounted member. The members rotatably coact with one another so that gravity causes the frame to seek a vertical position. Notches are provided to assist in vertically mounting the wall-mounted member. No means for slidably adjusting the horizontal position of the frame is disclosed.

U.S. Pat. No. 4,458,873 to Sutherland discloses a one-piece clip apparatus for use with frames having an inwardly facing channel along the upper periphery thereof.

U.S. Pat. No. 4,531,315 to Sobel describes a corner bracket for use in assembling frames incorporating universal assembly channels.

U.S. Pat. No. 5,080,317 to Letizia discloses a picture anchoring assembly utilizing a spirit level to assure the level mounting of a picture frame.

U.S. Pat. No. 3,552,708 to Hillstrom describes a picture hanging apparatus including a picture frame element having a hollow recess and a frame-mounted clip insertable into the frame recess mounting for mounting on a nail.

U.S. Pat. No. 4,220,309 to Eisen, et al. discloses a method and apparatus for positioning frame-hanging devices upon a wall to assure proper placement of the picture.

U.S. Des. Pat. No. 282,054 to Hoffman discloses an ornamental design for a picture hanging aide.

Also known are opposing pairs of roughly triangular devices removably slidable within the side frame channels of a frame. Each of the devices has a hole on one wing thereof permitting connection of a wire between the pair of devices. The wire can then be placed over a nail on a wall or other vertical surface, thereby supporting the frame.

Nevertheless, the frustration of attempting to hang framed artwork with the traditional "hook and wire" method continues to be a nearly universal experience. Even utilizing more than one hook, it is difficult to maintain a frame straight and level using the traditional method. Frames suspended by the standard hook and wire method tend to fall away from the wall at the top, resulting in unattractive gaps between the wall and the top of the frame. Moreover, it is practically impossible to align a series of frames (either vertically or horizontally) using the hook and wire system due to the variations in wire placement, and lengths and flexibility of differing wire types. This configuration also results in the picture's load-vector being directed down the wall providing no wall support for the hanger device. Proper frame hangers should be designed to direct load-vectors into the wall to provide optimum support for the valuable framed art installed on them.

Parent application Ser. No. 07/822,061, entitled "Apparatuses and Methods for Hanging Frames" to Hart, filed Jan. 14, 1992, relates to an apparatus and method for hanging frames on a mounting surface. The apparatus of the invention comprises a mostly planar body with a protruding supporting rail, a bracket recess, mounting holes and two distinct means for assuring the horizontal, level, mounting of the body upon the mounting surface. The means for assuring a level mounting include the use of a removable spirit level or, alternatively, alignment notches to align the body relative to a horizontal line on the mounting surface. The apparatus is particularly well suited for use with metal frames having universal assembly channels, as the supporting rail of the body is designed to be inserted within universal assembly channels to securely yet slidably and removably attach the apparatus to a frame. Use of a common Z-bracket to adapt the invention to ordinary wooden frames is also disclosed. The teachings of the parent application Ser. No. 07/822,061 are hereby incorporated by reference.

SUMMARY OF THE INVENTION

(DISCLOSURE OF THE INVENTION)

The present invention is of apparatuses for hanging a frame on a surface as well as of methods for hanging frames.

The primary apparatus of the invention comprises a body having a front, a back, and a top; a slidable attachment of the body to the top of the frame; and an attachment of the body to the target surface. In the preferred embodiment, the apparatus further comprises a spirit level removably attached to the body for aligning the body on the surface and the body comprises protruding clip retainers for holding the spirit level. Alternatively, alignment may be performed by at least two alignment notches (preferably V-shaped) disposed on sides of the body, the notches being alignable to a straight line marked on the surface. The removably slidable attachment is preferably a supporting rail disposed on the front of the body which throughout its length protrudes perpendicularly from the front and which has a cross section corresponding to a channel in the frame thereby permitting slidable insertion of the supporting rail in the frame channel. The invention includes, however, a designed adapter bracket and method for practicing the invention on standard wooden or other material frames. Alternatively, the removably slidable attachment may comprise a recession disposed on the back of the body and a Z-bracket removably and slidably attachable to the frame having a leg corresponding to the recession.

The attachment of the body to the target surface preferably comprises at least two openings completely penetrating the body from front to back capable of holding fasteners. Preferably, at least one of the openings is near the center of the body and at least one penetrates the body at an oblique angle. The openings should have a diameter corresponding to the diameter of the fasteners.

The second apparatus of the invention comprises a body having a front, a back, and a top; an attachment of the body to the frame; at least two alignment notches in the body; and an attachment of the body to the target surface. Preferably, the alignment notches are V-shaped, disposed on sides of the body, and alignable to a straight line marked on the surface.

The first method of the invention comprises the steps of: (a) providing a hanger; (b) placing the hanger flush against a mounting surface; (c) inserting at least one fastener at least partially into the hanger; (d) positioning the hanger at a desired location upon the mounting surface; (e) inserting the first fastener completely through the hanger and into the mounting surface; (f) referring to a spirit level disposed on the hanger; (g) rotating the hanger about the first fastener until the hanger is horizontal according to the spirit level; and (h) inserting at least one additional fastener through the hanger and into the mounting surface to position and attach the hanger on the surface. The hanger preferably comprises a protruding elongated supporting rail with a shape corresponding to a universal assembly channel of the frame for removable and slidable attachment of the supporting rail within the universal assembly channel. Alternatively, the hanger comprises an elongated recess and an adapter bracket for removable and slidable disposition on the elongated recess.

The second method of the invention comprises the steps of: (a) providing a hanger having alignment notches; (b) marking a mounting surface with a straight guide line; (c) placing the hanger flush against the mounting surface; (d) aligning the alignment notches with the straight guide line; and (e) attaching the hanger to the mounting surface. In the preferred embodiment, the hanger is provided with V-shaped alignment notches on the sides of the hanger.

The third method of the invention comprises the steps of providing a hanger and slidably attaching the top of the frame to the hanger.

Additionally, special corner brackets and methods for their use are disclosed for utilizing a pair of hangers in heavy-duty application to mount large or heavy frames. Apparatuses and methods for securing the bottom of a frame to a mounting surface to assure a flush and fixed position are also described.

An object of the present invention is to provide a simple, inexpensive means and method for consistently hanging frames straight and level.

Another object of the present invention is to provide an apparatus for hanging frames that is easy to use.

Another object of the present invention is to provide an apparatus for hanging frames that is inexpensively manufactured.

Another object of the present invention is to provide a means and method for consistently hanging frames straight and level that requires no attachments upon the frame.

Another object of the present invention is to provide a means and method for hanging frames that secures the frame flush against the wall or other surface.

Another object of the invention is to provide a means and a method for securing the bottoms of frames against disturbance due to earthquake, malicious tampering, and the like.

It is another object of the present invention to provide a means and method for hanging multiple frames in horizontal alignment.

Still another object of the present invention is to provide a means and method for hanging multiple frames in vertical alignment.

Another object of the present invention is to provide a means and method for hanging frames of various weights and types.

Other objects, advantages, and novel features, and further scope of applicability of the present invention will be set forth in part in the detailed description to follow, taken in conjunction with the accompanying drawings, and in part will become apparent to those skilled in the art upon examination of the following, or may be learned by practicing the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principle of the invention. The drawings are only for the purpose of illustrating a preferred embodiment of the invention and are not to be construed as limiting the invention.

DESCRIPTION OF THE PREFERRED EMBODIMENT

(BEST MODE FOR CARRYING OUT THE INVENTION)

The primary embodiment of the present invention is a simple, one-piece frame positioning bracket for hanging artwork, picture frames or like objects upon a wall or other mounting surface. The apparatus is particularly suited for use with metal picture frames having universal assembly channels, although by utilizing adapter devices the apparatus may satisfactorily be practiced with a wide variety of frame types. The design and configuration of the apparatus permit the user consistently to mount frames upon walls in a straight and level manner and flush against the wall. A horizontal rail feature of the apparatus, which accepts a metal frame's universal assembly channel, permits lateral, side-to-side adjustment of a frame once it has been hung. Other elements of the apparatus of the invention permit the user easily to utilize a plurality of the apparatus to hang numbers of frames in horizontal and/or vertical alignment, while assuring that each frame retains its level position upon the wall. The apparatus may be any practicable size; thus, the apparatus may be produced in a variety of sizes.

Reference is made to FIGS. 1–7 which illustrate the preferred apparatus of the invention. The apparatus includes a body 10, made of injection-molded plastic or any other inexpensive, durable material. The material of body 10 preferably is somewhat elastic, such that body 10 generally is quite stiff, but with some resilient flexibility in response to focused loading. Body 10 is substantially planar, with the exception of certain protruding features later described herein.

Figure 1:
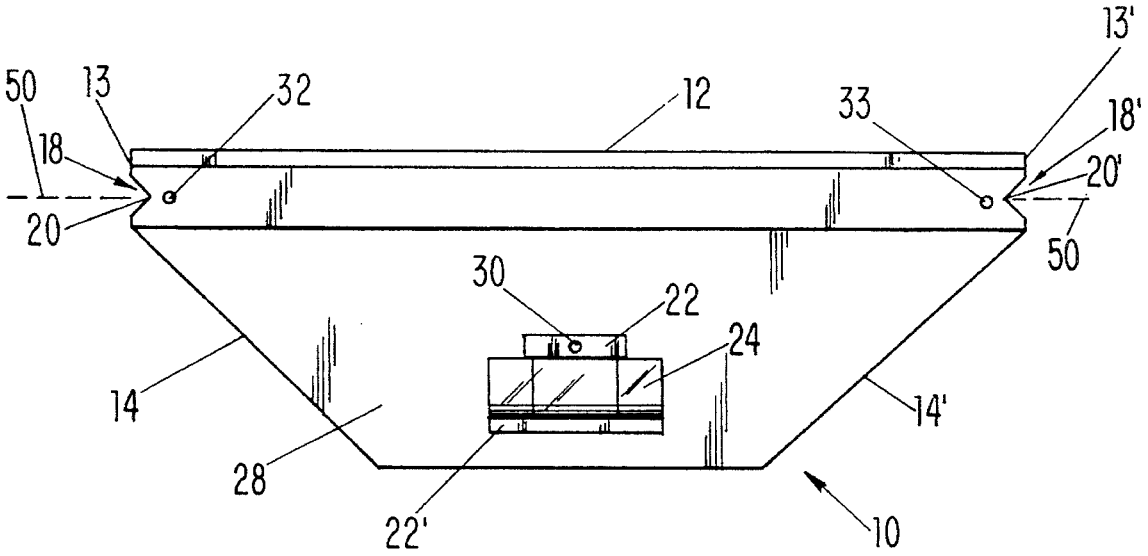
FIG. 1 is a plan view of the front of the preferred embodiment of the apparatus of the invention.
Figure 2:
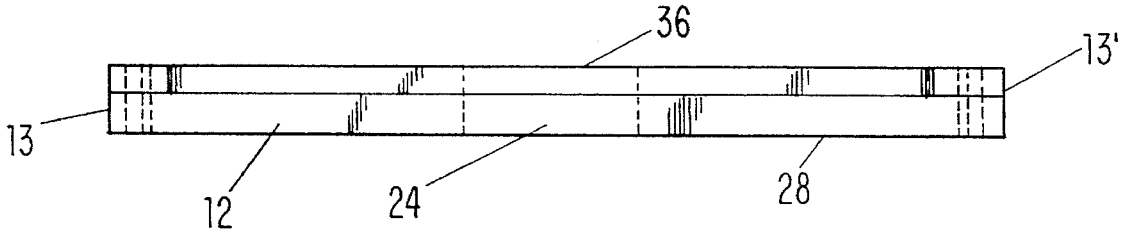
FIG. 2 is a plan view of the top of the FIG. 1 embodiment.
Figure 5:
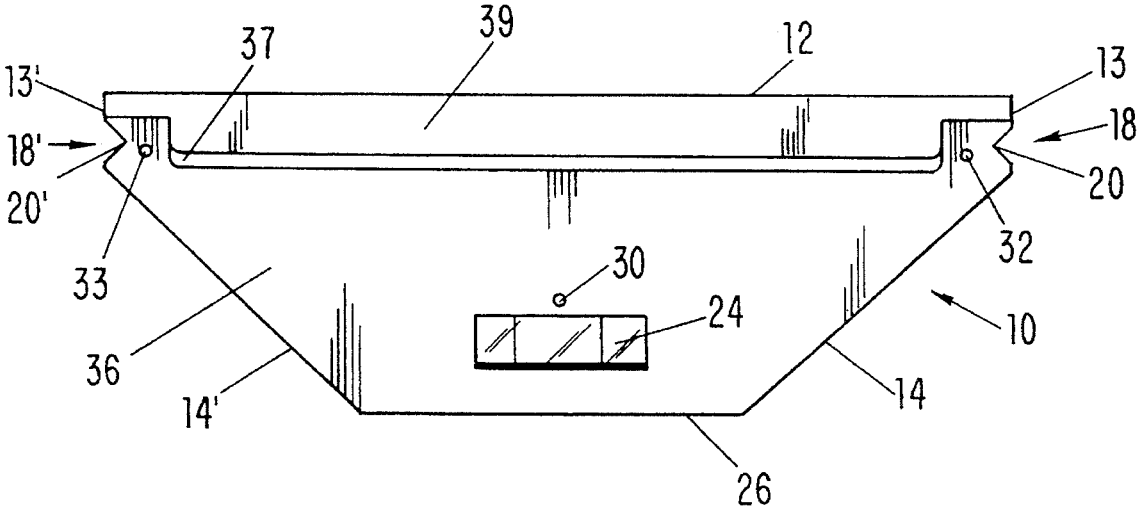
FIG. 5 is a plan view of the back of the FIG. 1 embodiment.

Body 10 preferably is generally trapezoidal in shape when viewed from the front, the longer of the parallel sides of the trapezoid being the top 12 of the apparatus. Other shapes (e.g. rectangular, square, triangular, etc.) may also be used. The trapezoidal section of body 10 is truncated at each location where the non-parallel sides 14,14' otherwise would intersect with top 12, in order to create short vertical sides 13,13' at right angles with top 12. Alignment notches 18,18' are linear-sided recesses formed into vertical sides 13,13' of body 10. As best illustrated in FIGS. 1 and 5, alignment notches 18, 18' are formed in the shape of triangles, with one side of each triangle collinear with one of vertical sides 13,13'. Equilateral triangles are preferred, although isosceles triangles will also suffice (provided the odd sides of isosceles triangles are collinear with corresponding vertical sides 13,13'). Interior vertices 20,20' of alignment notches 18,18' are situated at points equidistant from top 12, so that the line defined by interior vertices 20,20' is parallel to top 12.

Importantly, alignment notches 18,18' are situated such that the line defined by their interior vertices 20,20' bisects the interior angles of both alignment notches 18,18'.

Clip retainers 22,22' grasp spirit level 24. Clip retainers 22,22' protrude from the front 28 of body 10. Throughout this specification, it shall be understood that the front 28 of the apparatus shall be adjacent to and in contact with the item of art to be hung, while back 36 is the face of the apparatus that shall be in direct contact with the wall. Clip retainers 22,22' preferably are an integral part of body 10, that is, they are formed of the same material as body 10 and are an extension thereof. Clip retainers 22,22' may be located nearly anywhere on front 28 of body 10; in the preferred embodiment they are located near and parallel to the bottom 26 of body 10, equidistant from non-parallel sides 14,14'. Importantly, clip retainers 22,22' are parallel to each other and with the top 12 of the apparatus. Clip retainers 22,22' are elongated, and are so formed as to exploit the elastic nature of the composition material; their flexibility permits spirit level 24 to be removably inserted between them such that spirit level 24 is securely grasped by clip retainers 22,22' while the apparatus is in use. Likewise, spirit level 24 may be removed from the grasp of clip retainers 22,22' when the apparatus is not in use, with the result that the resiliency of clip retainers 22,22' causes them to spring back to their original configuration.

Figure 6:
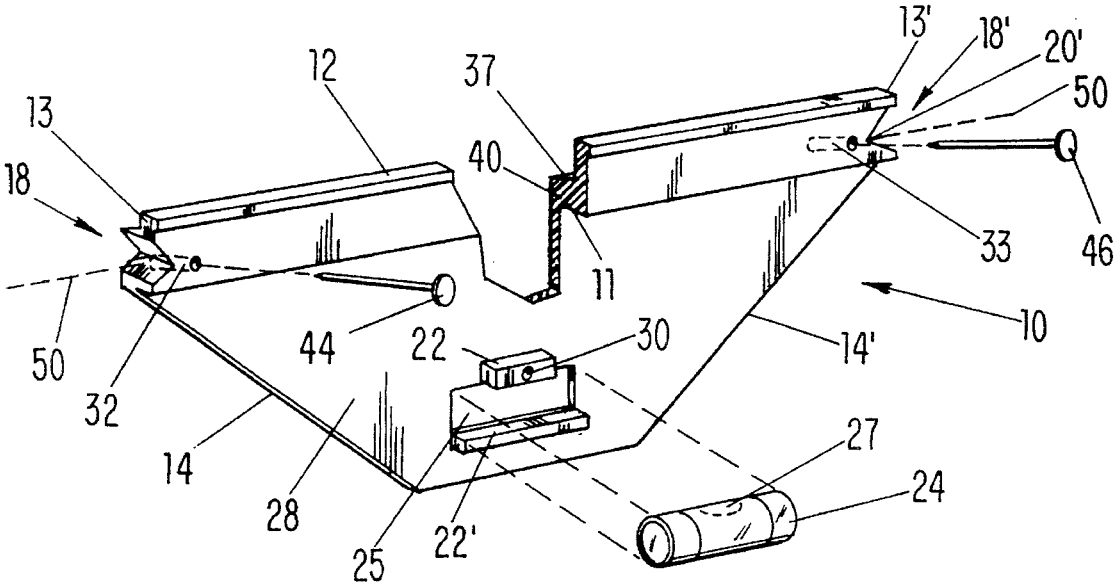
FIG. 6 is a perspective view of the front of the FIG. 1 embodiment with a portion of the apparatus broken away to illustrate a partial cross section of the apparatus.

If necessary to accommodate the reception of spirit level 24 between clip retainers 22,22', body 10, as shown in FIG. 6, may include spirit level opening 25. Spirit level opening 25 is a rectangular opening through body 10, between clip retainers 22,22', that allows spirit level 24 to be inserted between clip retainers 22,22' and remain in position while the apparatus is in use. Clip retainers 22,22' extend outwardly at a sufficient distance to be even with or beyond spirit level 24, to prevent spirit level 24 from being damaged. Spirit level opening 25 alternatively may be a depression (e.g. concave) rather than an opening.

Figure 3:
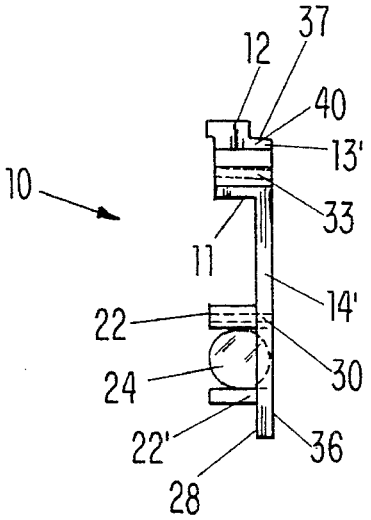
FIG. 3 is a plan view of the side of the FIG. 1 embodiment.
Figure 4:
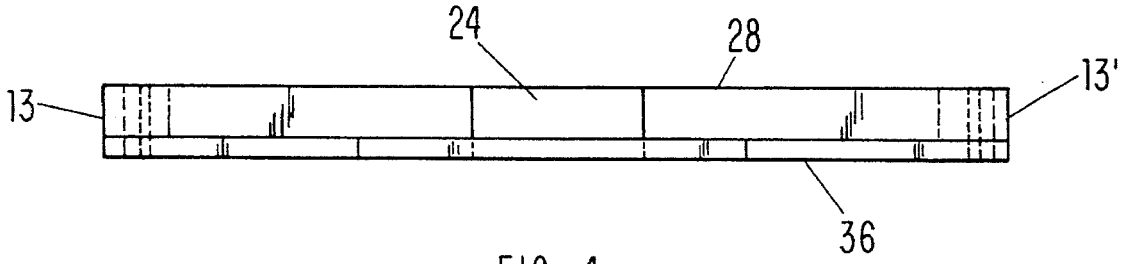
FIG. 4 is a plan view of the bottom of the FIG. 1 embodiment.

As best illustrated in FIG. 3, a portion of body 10 is of additional thickness to form reinforcing rib 11, which runs parallel and adjacent to top 12. Reinforcing rib 11 is observed to be an integral part of body 10 in the shape of a long box extending between vertical sides 13,13'.

Referring to FIGS. 1 and 3, it is seen that extending upwardly and outwardly from reinforcing rib 11 is supporting rail 40, which, like reinforcing rib 11, preferably is an integral part of body 10 and composed of the same material. Supporting rail 40 runs between vertical sides 13,13', adjacent to and along the entire length of top 12. As more particularly illustrated in FIG. 3, supporting rail 40 has a stepped profile, as it extends outward from front 28 a distance approximating the depth of a corresponding frame, and also upward a small distance from top 12. As best shown in FIG. 6, supporting rail 40 and reinforcing rib 11 together present a particular universal cross section throughout their common length. This unique cross section is so designed as to permit the apparatus of the invention specially to interlock with the frame to be hung.

As shown in FIGS. 1 and 6, the uppermost of the two clip retainers 22,22', which preferably is an integral portion of body 10, has additional thickness for purposes of strengthening the apparatus and accommodating a specialized mounting hole 30 as shall hereinafter be described. It is observed, therefore, that excepting clip retainers 22,22' and supporting rail 40, which protrude from the face of front 28, front 28 preferably is smooth and flat.

Brief reference is made to FIGS. 3, 5–7, 14, and 18, showing back 36 of body 10. Back 36 is substantially smooth and flat, which characteristic permits the apparatus to be mounted flush against a wall or other flat mounting media. The semi-flexible character of body 10 also permits the satisfactory mounting of the apparatus to walls or other media having a slight curvature or minute surface irregularities. Back 36 has rear ledge 37, which is a horizontal surface parallel to the plane of top 12 resulting from the abrupt narrowing in the thickness of body 10 along top 12. This narrowed thickness in body 10 is manifested in the form of a bracket recess 39 also running the width of top 12 at a depth equivalent to the depth of rear ledge 37. Rear ledge 37 runs the entirety, or nearly the entirety, of the width of top 12; it may be modified as needed to accommodate the location of side mounting holes 32 and 33, as illustrated in FIG. 5.

Body 10 further comprises central mounting hole 30, and side mounting holes 32 and 33. Central mounting hole 30 and side mounting holes 32 and 33 are small-diameter holes drilled or otherwise formed as to completely penetrate through body 10 from front 28 to back 36. Central mounting hole 30 is situated equidistant from non-parallel sides 14,14' at the center of the uppermost of the two clip retainers 22,22'. The uppermost clip retainer 22, preferably is of greater mass than lower clip retainer 22', so as to be reinforced to accommodate central mounting hole 30. Side mounting holes 32 and 33 each penetrate reinforcing rib 11 near the ends of top 12, a short distance from the respective interior vertices of alignment notches 18,18'.

Specific reference is made to FIG. 3. It is noted that side mounting holes 32 and 33 penetrate body 10 at oblique angles downward from front 28 to back 36, such that the openings of the holes on front 28 are somewhat closer to top 12 than the corresponding openings on back 36. Central mounting hole 30 penetrates body 10 at an angle normal to front 28 and back 36. The diameters of central mounting hole 30 and side mounting holes 32 and 33 are preferably approximately equal to, or slightly less than, the diameter of the fasteners with which the apparatus will be hung and the holes are preferably tapered to hold the nail firmly during mounting. Preferably, the diameters of the mounting holes 30,32,33 are just slightly less than the diameters of the fasteners to be used, so that a slight amount of force may be required to insert the fasteners into the mounting holes 30,32,33. These features of the apparatus allow the three mounting holes 30,32,33 to serve as "nail keepers" which grasp and hold the nails or screws while the user hammers or turns the fasteners into the wall. In the preferred embodiment, the fasteners to be used are nails. Alternatively, screws may be used to hang the apparatus. An advantage of the invention is, therefore, that it is easily practiced by a single user; the apparatus' three mounting holes 30,32,33 hold the fasteners, thus freeing one of the user's hands to operate a hammer or screwdriver while the other hand holds the apparatus 10 in place.

Figure 7:
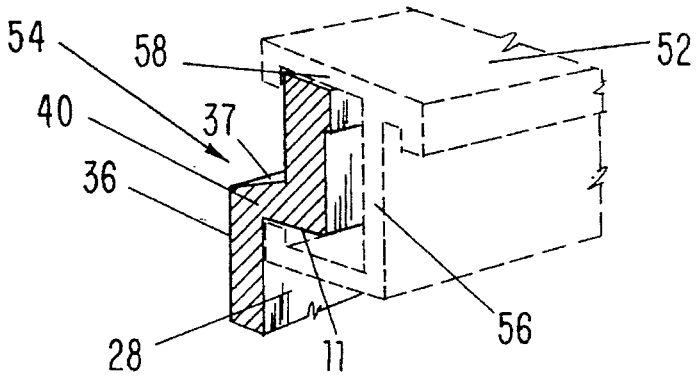
FIG. 7 is a perspective view of the FIG. 1 embodiment shown mounted in a typical metal frame channel.

The preferred method of practicing the invention is best understood with reference to FIGS. 6 and 7. Spirit level 24 is snapped into position between clip retainers 22,22' on the front 28 of the apparatus 10 and into spirit level opening 25 as needed. The apparatus 10 is then placed against the wall or other mounting medium, and held by hand at the desired mounting location. Top 12 of the apparatus is positioned approximately horizontal on the wall and slightly below the desired location of the top of the frame to be hung. The user then manually inserts nails 44,46 (only two shown) or other suitable fasteners into central mounting hole 30 and side mounting holes 32 and 33. The "nail keeper" advantage of the invention comes into play as the snug fit between the fasteners and the mounting holes 30,32,33 causes the fasteners to remain within the mounting holes 30,32,33, in ready position to be hammered or screwed, while the user's hands are freed to position the apparatus 10 and wield tools.

Using spirit level 24, the user adjusts and manipulates the apparatus 10 until it is in a level position on the wall as shown by the level 24. It is easily observed that when the bubble 27 in spirit level 24 gives visual indication that spirit level 24 is level, the entire apparatus 10 likewise will be level, with both top 12 and supporting rail 40 in horizontal position (and presumably parallel to the floor and ceiling).

Holding the apparatus 10 thus positioned with one hand, with the other hand the user hammers the nail (not shown) disposed within central mounting hole 30 through central mounting hole 30 and into the wall. The nail is not hammered completely into the wall; a small length of nail is left exposed between the apparatus and the head of the nail so that the apparatus remains free to rotate about the nail. This continued freedom of rotation about the central fastener allows the user to perform any further required positional adjustments to restore and maintain the apparatus' horizontal disposition.

Having constant reference to spirit level 24, the user maintains the apparatus in a level position while a side nail 44 (or alternatively 46), held by either of the two side mounting holes 32 (or alternatively 33), is hammered through the side hole 32 and into the wall. This side nail 44 through side mounting hole 32 is gently hammered until the head of the side nail 44 is snug against the front 28 of the apparatus and the apparatus is securely held thereby. During the hammering of this first side nail 44, the user exercises care to maintain the horizontal position of the apparatus; in the event the apparatus is mispositioned, the first side nail 44 is withdrawn, the apparatus is readjusted, and hammering is recommenced.

Once the first side nail 44 or 46 is hammered into position, the unhammered second side nail 46 (or alternatively 44) in the other side mounting hole 33 (or alternatively 32) is also hammered home. The user will no longer need manually to hold the apparatus in place, as it is secured by the nail through the central mounting hole and by the first side nail 44. Because the latter two fasteners are already secured within the wall, the level position of the apparatus is fixed, and not easily disturbed during the hammering of the second side nail 46. Finally, the nail through central mounting hole 30 is gently hammered until its head is snug against the front 28 of the apparatus. It thus is noted that the triangular arrangement of the mounting holes and fasteners, and the sequential securing of the fasteners as described, permits the user easily to attach the apparatus to the wall in a level position through constant reference to spirit level 24.

While the preferred embodiment of the apparatus contemplates the use of three fasteners, it will be apparent to one skilled in the art and having reference to the above disclosure that any number of fasteners greater than one will suffice. Specifically, it is noted that two fasteners, with corresponding mounting holes, would permit the invention adequately to be practiced; additional numbers of fasteners provide added security.

If desired, spirit level 24 may then be removed from the apparatus and reused in another apparatus of the invention. Alternatively, spirit level may remain in the apparatus, where it will be covered by the artwork and thus be invisible to observers.

Thus secured to the wall, the apparatus is ready to accept a frame for hanging. Further explanation of the hanging method shall follow hereinafter.

An alternative method of practicing the invention is particularly well suited to hanging multiple frames in a horizontal line of display. Using a tape measure or spirit level and a carpenter's chalk line, or other conventional means, the user of the invention causes a thin (approximately 1 mm) horizontal line (shown in FIG. 1 as a dashed line 50) to be temporarily marked upon the wall or other mounting medium. Such a line 50 should be sufficiently long to accommodate the desired number of frames at the desired horizontal spacing. The height of the line 50 above the floor should be approximately the desired distance from the floor to the tops of the frames.

Reference is made to FIGS. 1 and 6. With the temporary horizontal line 50 on the wall serving as a guide, alignment notches 18,18' are used in lieu of a spirit level to assure the horizontal positioning of the apparatus. The user first inserts the desired fasteners into central mounting hole 30 and side mounting holes 32 and 33, as in the preferred methodology described above. The user then places the apparatus 10 against the wall so that both interior vertices 20,20' of alignment notches 18,18' are located precisely upon the horizontal wall line 50, i.e., such that the horizontal wall line 50 bisects exactly the interior angles of alignment notches 18,18'. The fasteners, preferably nails, are then hammered into the wall in the same order and manner as described in the preferred methodology, except that the user has constant reference to the horizontal wall line 50, instead of a spirit level, in order to maintain the level position of the apparatus 10 during hanging. Assuming that the horizontal wall line 50 is truly level, placing the interior vertices 20,20' of alignment notches 18,18' upon that line 50 will assure the horizontal position of the apparatus 10 and its supporting rail 40. Visible portions of the horizontal wall line 50 may be erased after the artwork(s) are hung in final position.

It here is noted that the methodology described immediately above may have application to objects, other than frames, to be attached to a surface. The method may be practiced with nearly any device upon which another item will be attached. Likewise, the surface need not be a wall, but can be any surface to which a frame or other device needs to be attached.

In all embodiments and methodologies, the order of certain of the method steps may be varied without adversely affecting the practice of the invention. The fasteners may be inserted in the mounting holes either before or after the apparatus is placed against the wall; the fasteners may be inserted either before or after the apparatus is leveled; the order in which the fastening nails are hammered home may be varied; and the like. The method claims are thus not limited to the order of steps set forth therein.

Figure 8:
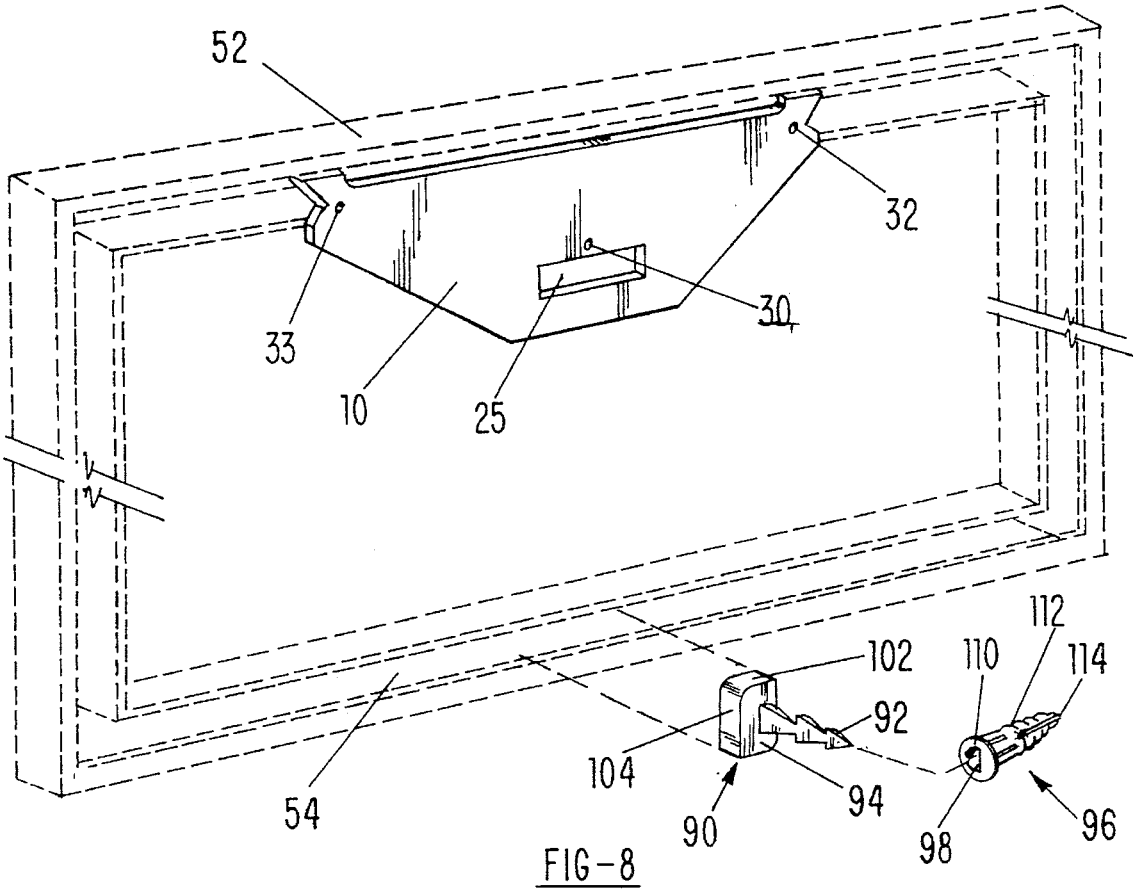
FIG. 8 is a perspective view of the FIG. 1 embodiment mounted upon a frame and bottom retaining pin and socket of the invention.
Figure 9:
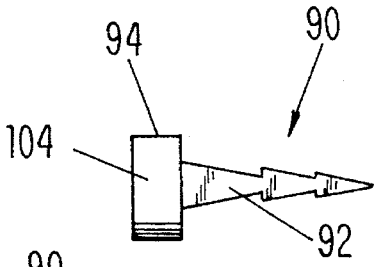
FIG. 9 is a side view of the bottom retaining pin and socket embodiment of FIG. 8.
Figure 11:
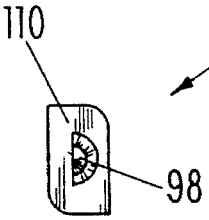
FIG. 11 is a top plan view of the bottom retaining pin embodiment of FIG. 8.
Figure 10:
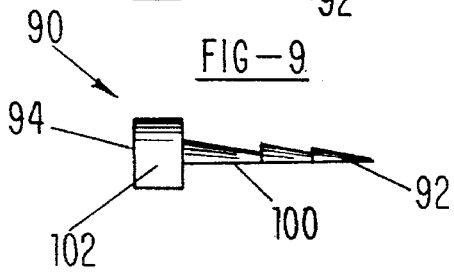
FIG. 10 is a front view of the bottom retaining pin embodiment of FIG. 8.
Figure 12:
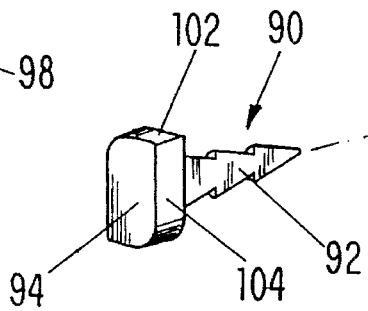
FIG. 12 is a perspective view of the bottom retaining pin embodiment of FIG. 8.
Figure 13:
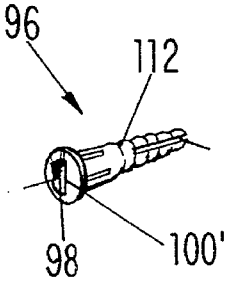
FIG. 13 is a perspective view of the socket embodiment of FIG. 8.

Reference is now made to FIGS. 7 and 8. Metal artwork frames 52 commonly used in the art are typically fashioned from lengths of molded or extruded aluminum or other inexpensive material. These sections of material normally are molded or extruded to include, as an integral part of the frame, universal assembly channels 54—recesses within the four sections of the frame, used to accommodate the right-angle brackets used to attach the sections together. The universal assembly channel 54 has a universal angular C-shaped cross section 56, runs the entire length along the interior of the frame's sides, top and bottom, and permits the installation of right-angle brackets within the channels at the frame's interior corners. The open portion of the C-shaped cross section 56 opens outwardly to the rear of the frame (e.g. toward the wall). Accordingly, the universal assembly channel 54 is hidden against the wall when the picture is hung. The uppermost section of the universal assembly channel 54, as it runs along the inside of the top section of the frame, serves as a lip or rib 58 which may be received onto a customized mount attached to a wall. It is an object of the present invention to provide just such a customized mount.

Once the apparatus of body 10 is securely attached to the wall or other mounting medium, a picture frame is easily hung thereon using supporting rail 40. As may be noted from the drawings, when the apparatus properly has been installed on the wall, supporting rail 40 extends outward and upward, i.e. away from the wall. It thus effectively serves as a continuous mount running the width of the apparatus, upon which the picture frame may be hung. The simplicity of the invention is exploited by lifting the framed art to the apparatus, and manipulating the frame until the entire length of supporting rail 40 is inserted into the universal assembly channel 54 within the top section of the frame. While hanging the frame upon the apparatus, it is necessary to hold the frame at an angle (e.g., 45°), the top section closer to the wall, in order to facilitate the entry of supporting rail 40 into the universal assembly channel 54. Once supporting rail 40 has been disposed in the universal assembly channel 54, the frame is then gently rested against the wall and left to hang upon the apparatus body 10, where it is locked onto the rail and cannot be accidentally dislodged.

The uppermost portion of the universal assembly channel 54 (having, as it does, a C-shaped cross-section 56) provides not only a horizontal surface which rests upon the top of supporting rail 40 and thus supports the frame, but also a vertical, downwardly projecting surface that is situated between supporting rail 40 and the wall. Supporting rail 40 and the universal assembly channel thus interlock. When properly engaged, therefore, the length of supporting rail 40 fills some or nearly all the void of the universal assembly channel 54, and prevents the frame from being pulled away from the wall without first being lifted up and over supporting rail 40. As can be seen, no hanging wires, hooks, or other devices are required to be attached to the frame; the attached apparatus 10 of the invention, by fitting into the universal assembly channel 54 provides both wall attachments and frame attachments. The horizontal position of the frame may easily be adjusted merely by sliding the frame back and forth upon supporting rail 40, which is free to slide within the universal assembly channel.

Figure 22:
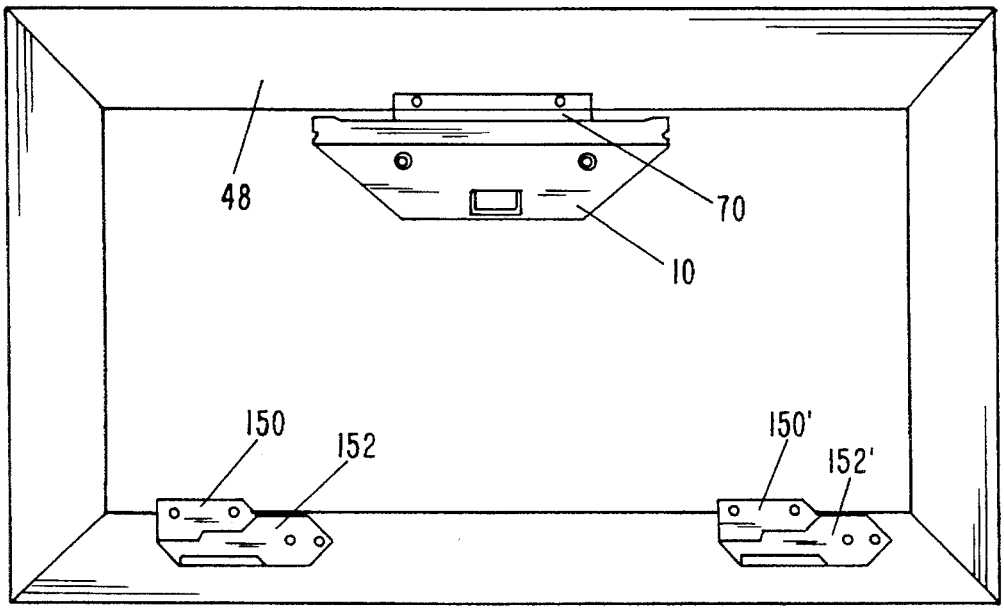
FIG. 22 is a view of the FIG. 14 embodiment, showing two bottom-retaining key and latch elements according to the invention, mounted upon the back of a frame.

Used alone, body 10 causes a frame to hang flush against the wall, yet permits the bottom of the frame to be swung outward from the wall and the frame to be moved from side to side. It may be desired to supplement the apparatus of body 10 with a means for securing the frame against the wall via the bottom of the frame. The invention includes the optional use of bottom retaining pin 90 in conjunction with socket 96, as shown in FIGS. 8–13. Bottom retaining pin 90 is locked into the universal assembly channel 54 of the frame, and then inserted in socket 96 which has been mounted in the wall. Alternatively, one or more sets of latch 150 and key 152 elements, as shown in FIG. 22, may be utilized for securing the frame against the wall via the bottom of the frame.

Reference is made to FIGS. 8–13, showing the pin and socket elements of the invention for securing the bottom of the frame Bottom retaining pin 90 includes shank 92 and pin head 94. Shank 92 is shaped so as to be readily insertable into, but not easily withdrawn from, the void 98 of socket 96. Alternatively, pin 90 can be inserted directly into the wall. Pin head 94 is of a rectangular box shape and is shaped for placement within the interior of the C-shaped cross section 56 of the universal assembly channel 54 forming the bottom of the frame. Narrow side 102 of pin head 94 has a sufficiently short dimension to allow pin head 94 to be inserted into C-shaped cross section 56. Wide side 104 has a sufficiently long dimension as to cause pin head 94 to be interlocked within universal assembly channel 54 after having been rotated ninety degrees about the axis of shank 92.

Socket 96 is preferably fashioned of flexible plastic. It is very generally in the shape of a hollow frustum and is preferably shaped similarly to bottom retaining pin 90 to directionally receive bottom retaining pin 90. Opening at base 110 is interior void 98. Wall 112 of socket 96 may be cut with one or more slits 114 to give the entire socket 96 an added measure of expandibility when shank 92 is inserted therein. Void 98 and shank 92 preferably have corresponding flat surfaces 100,100', shown in FIGS. 10 and 13, to key the insertion of bottom retaining pin 90 into socket 96.

The foregoing supplemental mounting system is quickly and easily used. After the frame has been hung (upon a mounted body 10 of the invention or otherwise), the bottom of the frame is lifted away from the wall. A bottom retaining pin 90 is manipulated so as to place wide side 104 of pin head 94 parallel to the longitude of the (horizontal) bottom universal assembly channel 54 of the frame, thus permitting pin head 94 to be inserted into the interior of the C-shaped cross section 56 thereof, owing to the short dimension of narrow side 102. Bottom retaining pin 90 is then rotated ninety degrees about the axis of shank 92, placing wide side 104 in a vertical attitude within the universal assembly channel 54 and interlocking the bottom retaining pin 90 in place therein.

Following the placement of the bottom retaining pin 90 within the bottom universal assembly channel 54, the frame is gently lowered until the tip of bottom retaining pin 90 contacts the wall. The point of contact is marked, the frame is again lifted away from the wall, and a hole is drilled or otherwise made at the mark, corresponding in diameter to the approximate average diameter of socket 96. Socket 96 is then securely inserted (narrow end first) into the wall, and the frame is lowered against the wall. Shank 92 of bottom retaining pin 90 is snugly inserted into void 98 of socket 96, thus firmly attaching the bottom of the frame to the wall. The keyed flat surfaces 100,100' of socket 96 and bottom retaining pin 90, respectively, are interpositioned to assure that pin head 94 is maintained at the proper position within universal assembly channel 54.

The invention may satisfactorily be practiced with frames lacking universal assembly channels. Attention is directed to FIGS. 14–21, illustrating adapter bracket 70. Adapter bracket 70 may be formed of any inexpensive, stiff material; preferably it is made of the same material as body 10 e.g. injection-molded plastic. Attached to an alternative frame 48 not having universal assembly channels, adapter bracket 70 allows the principal apparatus of the invention, body 10, to be used in conjunction with virtually any frame type, particularly wooden or plastic frames.

Adapter bracket 70 is rectilinear with a reinforcing ridge 72 running the length of top 74. Interior face 76 and exterior face 78 preferably are both smooth and flat, such that reinforcing ridge 72 forms a lip or rib protruding from interior face 76, and the opposing sides exterior face 78 and interior face 76 together constitute adapter bracket flange 84. At least two adapter fastener holes 80,80' extend through reinforcing ridge 72 near its ends and perpendicular to exterior face 78. Adapter fastener holes 80,80' are beveled at their openings.

Figure 14:
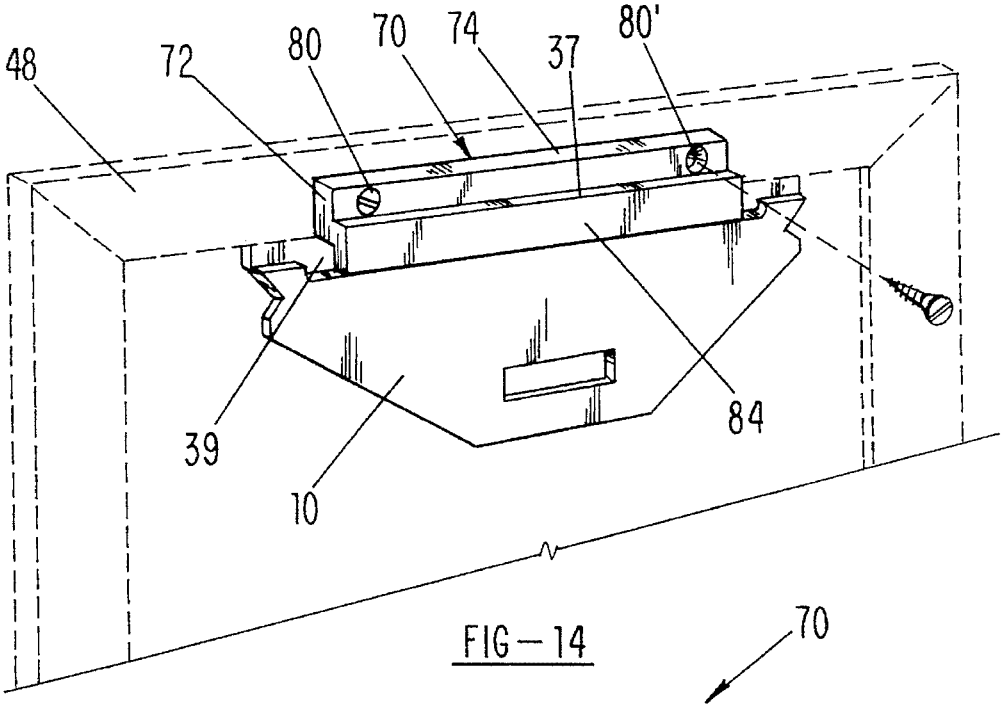
FIG. 14 is a perspective view of an alternative companion adapter embodiment mounted upon a frame in conjunction with the FIG. 1 embodiment.
Figure 15:
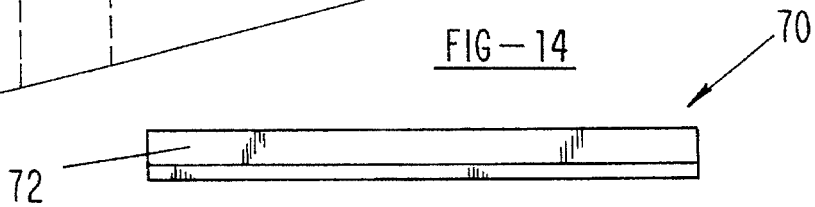
FIG. 15 is a top plan view of an alternative adapter bracket according to the invention.
Figure 16:
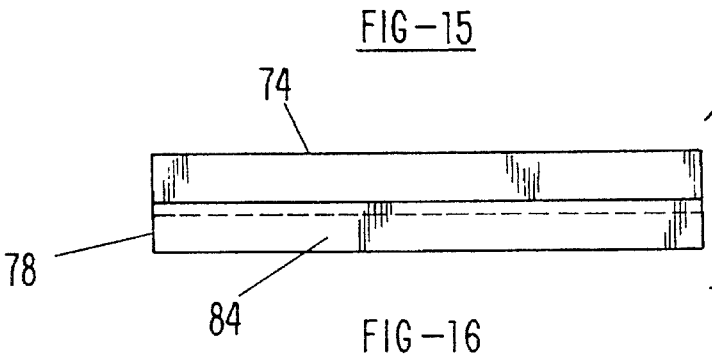
FIG. 16 is a front view of the FIG. 14 embodiment.
Figure 17:
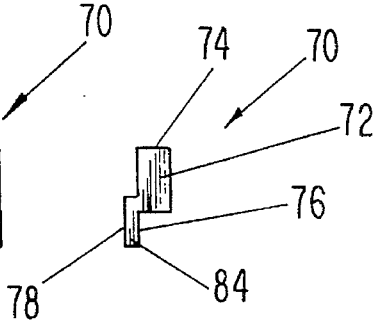
FIG. 17 is a side view of the FIG. 14 embodiment.
Figure 18:
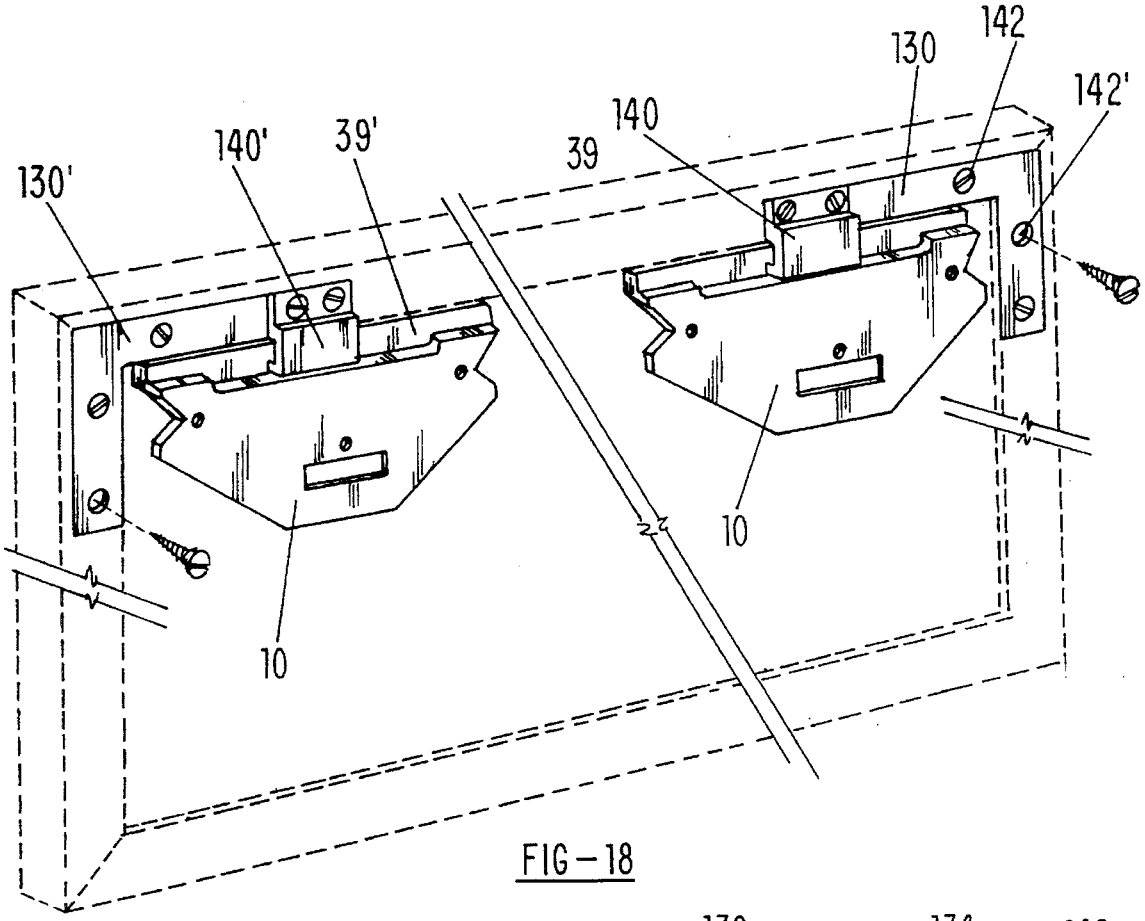
FIG. 18 is a perspective view of an alternative embodiment of the invention for mounting on, e.g., wooden frames.
Figure 19:
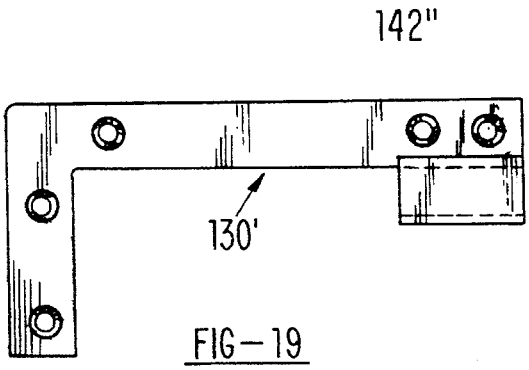
FIG. 19 is a front view of a right-hand corner bracket according to the apparatus of the invention.
Figure 20:
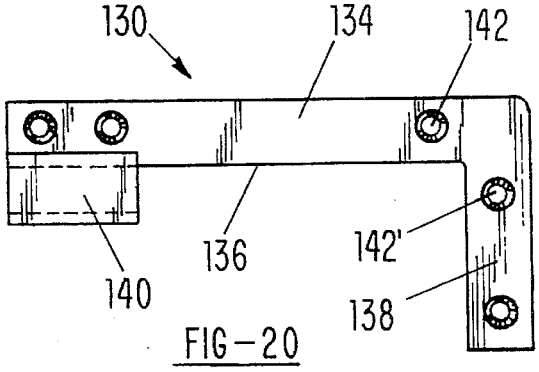
FIG. 20 is a front view of a left-hand corner bracket according to the apparatus of the invention.
Figure 21:
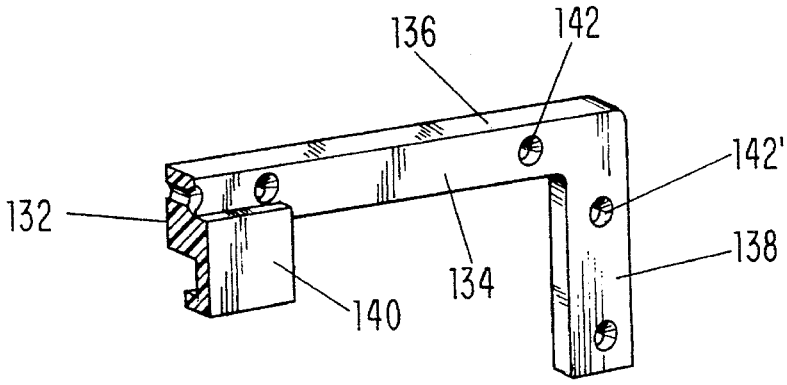
FIG. 21 is a perspective cross-sectional view of the FIG. 20 embodiment.

The use of adapter bracket 70 is straightforward. Referring to FIG. 14, adapter bracket 70 is mounted on the center of the back side (the side to be placed against the wall) of the frame 48. The adapter bracket 70 is mounted by placing reinforcing ridge 72 against the frame 48, with top 74 parallel to the top of frame 48, and with interior face 76 toward the frame 48. Utilizing adapter fastener holes 80,80', adapter bracket 70 is fastened to frame 48 with screws, nails, or the like. Fastener heads are recessed into then be hung upon a wall-mounted body 10 of the invention simply by beveled openings of adapter fastener holes 80,80'. The frame may then be hung upon a wall-mounted body 10 of the invention simply by inserting adapter bracket flange 84 into the bracket recess 39 between body 10 and the mounting surface.

In the alternative, a commonly available Z-bracket (disclosed and shown in FIG. 8 of the '061 application, and herein incorporated by reference) in place of adapter bracket 70 permits the invention to be applied to wooden frames, or other frames otherwise lacking universal assembly channels. The Z-bracket is securely attached to the center of the back of the top section of the frame. Using screws, brads or adhesives, one leg of the Z-bracket is horizontally affixed to the top section of the frame, aligned with the top thereof, while the other free leg protrudes outward and downward away from the frame.

When practiced with frames lacking universal assembly channels, the apparatus 10 is attached to the wall using either of the processes described above, i.e. level attachment using spirit level 24 or horizontal wall line 50. When attached flush against the wall, the apparatus 10 will nevertheless comprise a void or pocket between top 12 of body 10 and the wall, as a result of the presence of bracket recess 39.

With continued reference to FIG. 14, it is seen that alternative frame 48 may be hung upon the apparatus by gently placing the free leg of bracket adapter 70 or the Z-bracket into the void of bracket recess 39, between body 10 and the wall, until the bracket rests upon rear ledge 37. The frame's horizontal position may by further adjusted by sliding the bracket back and forth within bracket recess 39 and upon rear ledge 37.

Figure 28:
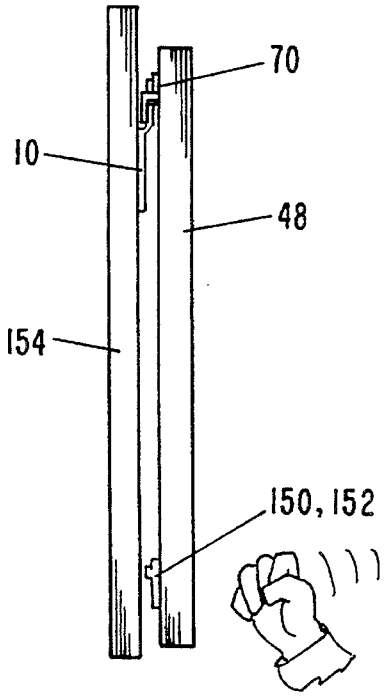
FIG. 28 is a side view of the embodiment of FIG. 22.

An alternative means and method of securing the bottom of frame 48 is especially adapted for use with the adapter bracket 70 and hanger apparatus 10 of the embodiment of the invention depicted in FIGS. 14–17. This alternative bottom retaining and securing means is generally shown in FIG. 22, with two sets of latch 150,150' and key 152,152' combinations mounted on the rear of frame 48. As shown in FIG. 28, the combination of latch 150 and key 152 is properly disposed between frame 48 and wall 154 when in use. Latch 150 and key 152 are fashioned from durable, resilient, slightly flexible plastic or like material.

The combination of latch 150 and key 152 is designed to compliment the use of the principal hanger body 10 in conjunction with the wood frame adapter bracket 70. The latch 150 and key 152 function to secure the bottoms of frames 48 to mounting media. Hanger body 10 and adapter bracket 10 are strongly preferred for use with latch 150 and key 152, as the latch 150 and key 152 combination is so configured as to exploit the ability of bracket 70 to slide laterally within the bracket recess 39 in body 10. Properly employed, the combination of latch 150 and key 152 provides security from vibrational disturbances such as earthquakes, sonic booms, and other inadvertent "bumps." Thefts are also discouraged, as the latch and key system provides added security against secretive removal of the frame from the wall.

Figure 23:
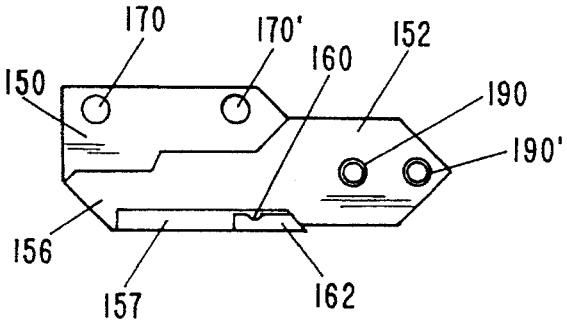
FIG. 23 is an enlarged front view of the key and latch elements of the embodiment of FIG. 22.

FIGS. 22 and 23 show latch 150 and key 152 when mutually engaged. It is readily observed that key 152 is so configured as to be laterally slidably inserted into a corresponding recession within latch 150. Key 152 is retained within latch 150 by the action of hook 156, which snaps over unrelieved ridge 157 in latch 150. Also, male detent 160 on key 152 fits into corresponding recess 162 in ridge 157.

Figure 24:
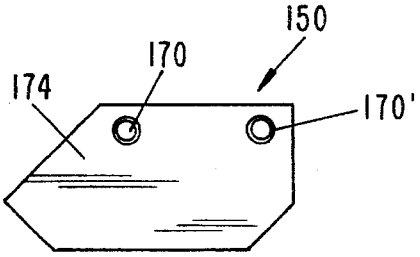
FIG. 24 is a back view of the latch element of the FIG. 23 embodiment.
Figure 25:
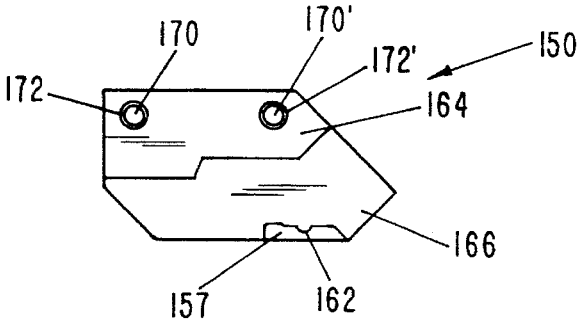
FIG. 25 is a front view of the embodiment of FIG. 24.

Reference to FIGS. 24 and 25 further clarifies the preferred configuration of latch 150. Latch 150 is generally a thin plane, except that its front is tooled or molded with certain biased features. Specifically, as shown in FIG. 25, the front side of latch 150 (the side to be disposed in immediate contact with the wall) has three principal features. A raised body or spine 164 is separated from lower ridge 157 by relieved keyway 166. As mentioned, ridge 157 is provided with a minor indentation or recess 162. Spine 164 is completely penetrated by at least two screw holes 170,170'. On this front side of latch 150, screw holes 170,170' are surrounded by raised indices 172,172' which are slightly elevated annular ridges about the circumferences of holes 172,172'. As will be further explained, raised indices 172, 172' serve to locate on the wall the positions of the screws when mounting latch 150 on the mounting medium. The front 174 of latch 150 is planar, except for the appearance of countersunk screw holes 170,170'.

Figure 26:
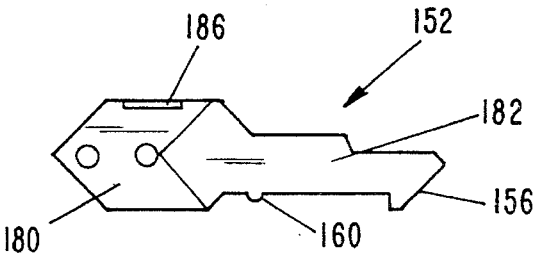
FIG. 26 is a back view of the key element of the FIG. 23 embodiment.
Figure 27:
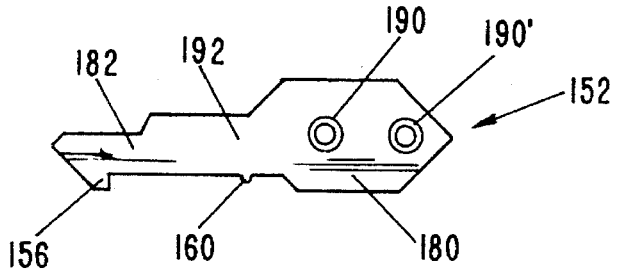
FIG. 27 is a front view of the embodiment of FIG. 26.

FIGS. 26 and 27 show that the general shape and contour of key 152 conforms and corresponds to keyway 166 in latch 150; when the invention is installed and practiced, key 152 is insertable into the relief of keyway 166, between latch 150 and the wall or other mounting medium. Key 152, like latch 150, is mostly planar. Spine 180, whose thickness preferably is about equal to the thickness of spine 164 on latch 150, is thicker than tooth 182. Accordingly, the thickness of tooth 182 approximates the difference in thickness between spine 164 and keyway 166 on latch 150. Tooth 182 features hook 156 at its distal end and male detent 160 on a side. Spine 180 also has raised positioning index 186 which may be aligned against the frame to insure proper positioning on the frame such that the key 152 is mounted parallel to the frame's bottom element Completely penetrating spine 180 in key 152 are at least two countersunk screw holes 190,190' for securing key 152 to the frame. As shown by FIG. 27, the front side 192, that is, the side which comes in contact with the wall, is planar and smooth except for the recessions of countersunk holes 190,190'.

The use of latch 150 and key 152 to secure the bottom of the frame to the wall is straightforward. Combined reference is made to FIGS. 14, 22, and 28. A hanger body 10 is attached to wall 154, properly positioned to support the frame 48 being installed, in the manner previously described herein. An appropriate adapter bracket 70 is then centered and attached to the reverse (wall-side) of the subject frame 48.

One or more (depending upon the size of the frame 48) latch-and-key assemblies (i.e., latch 150 with key 152 snapped in place therein) are installed upon the reverse of the bottom member of frame 48 as shown in FIG. 22, by inserting screws through screw holes 190,190' in key 152. (No screws are inserted through holes 170,170' at this time; latch 150 and key 152 are held together by the fitted insertion of key 152 into latch 150, including the "snapping" in place of indent 160 into recess 162, and hook 156 around ridge 157. Placement of the assemblies is so that key 152 is disposed between frame 48 and latch 150. Also, the raised indices 172,172' on latch 150 are disposed toward the wall 153 when the latch 150 and key 152 assembly is properly positioned upon frame 48. The preferred placement of the latch and key assemblies when employed in pairs (as shown in FIG. 22) is three or four inches inboard from the bottom corners of the frame 48. If a single assembly is employed on a relatively smaller frame, it is preferred that it be centered on the bottom member of the frame.

Subsequent to the attachment of the assemblies to the frame as described, the frame 48 equipped with adapter 70 is placed on the wall-mounted hanger body 10 such that the adapter 70 is approximately centered within the bracket recess 39 within hanger body 10. The bottom member of frame 48 is then held firmly against the wall 154 and mildly impacted (e.g. with a closed fist or soft rubber mallet) in the vicinity of each latch and key assembly, as illustrated in FIG. 28. The mild blows cause raised indices 172, 172 on latch 150 slightly to indent the wall 154, thereby marking wall 154 with perceptible circular depressions. These depressions may then be used to mark the precise locations where screws will penetrate wall 154 to secure latch 150 to the wall 154.

With the indentations from raised indices 172,172' marking the wall, the latch 150 is removed from each latch and key assembly by pulling the tooth 182 of key 152 out of the keyway 166 in latch 150. Latch 150 is then secured to the wall 154 (with keyway 166 facing wall 154) using screws or other fasteners through holes 170,170'. Proper positioning of latch 150 on wall 154 is accomplished by locating holes 170,170' in latch 150 over the indentations in wall 154 created by the impaction of raised indices 172,172'.

Figure 29:
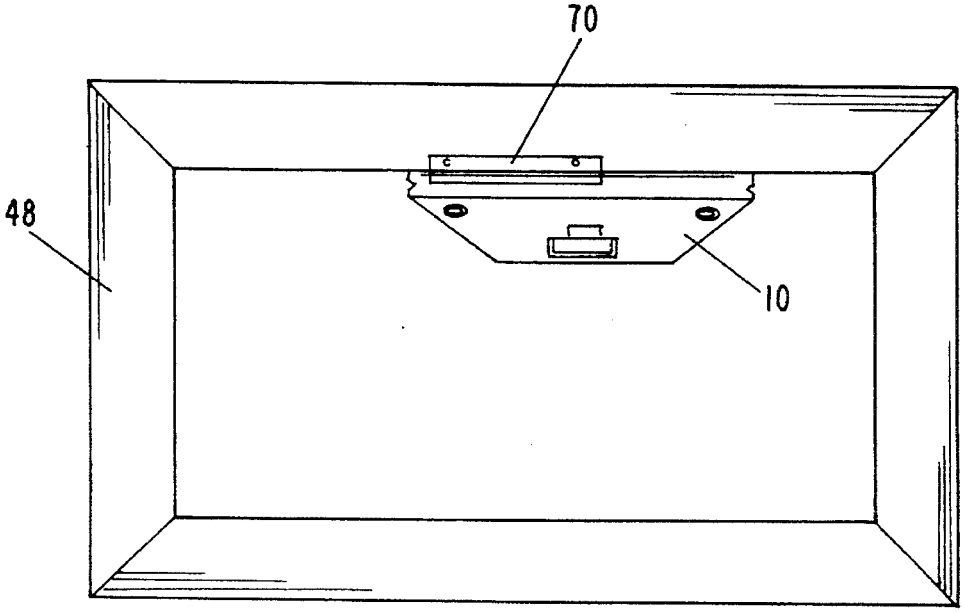
FIG. 29 is a back view of the FIG. 22 embodiment, showing the relative positions of the frame and hanger element of the invention prior to engagement of the key and latch elements of the invention.

Combined reference is now made to FIGS. 14, 22, 28, and 29. FIG. 29 illustrates frame 48, hanger 10 and adapter bracket 70 as they might appear from the room, with the actual artwork removed from the frame 48, except that bracket 70 ordinarily would be obscured behind frame 48 and hanger 10. With latch 150 mounted on wall 154, and a corresponding key 152 mounted upon the reverse of frame 48, the frame 48 is replaced upon hanger 10 such that adapter bracket 70 is disposed as far to the left within bracket recess 39 as possible without disturbing the level of frame 48. This permits the front side of key 152 to rest flush against wall 154. Tooth 182 of key 152 will be "aimed" at keyway 166 of latch 150 without actually being in contact with it.

The bottom of frame 48 is held firmly against the wall, and the entire frame is gently moved to the right (as shown by the arrows of FIG. 29) to insert the tip of tooth 182 into keyway 166 within latch 150. (With latch 150 secured to wall 154, keyway 166 will function as a tunnel or hollow between latch 150 and wall 154, into which the key 152 may be slidably inserted.) With tooth 182 at the threshold of keyway 166, the frame 48 is gently moved horizontally to and fro to "start" the tooth 182 of key 152 into the keyway 166 of latch 150. Once the tooth 182 is engaged into the keyway 166, the key 152 is forced home by the sideways forcing of the frame (from left to right as viewed from the room). Complete engagement occurs when hook 156 on key 152 snaps into place around latch 150, and when male detent 160 is seated within recess 162 in latch 150 (as shown in FIGS. 22 and 23).

The frame 48 can be removed from wall 154 by simply reversing the process, that is, by gently forcing or pushing the frame 48 from right to left until key 152 is forced from within latch 150 due to the resilient flexing of hook 156 and the popping of detent 160 out of recess 162. Frame 48 is then slid all the way to the left, clearing the tooth 182 from within the keyway 166. The frame 48 may then be lifted out and off of hanger 10.

Reference is now made to FIGS. 18–21, showing a pair of corner brackets 130,130' for use in hanging unusually wide or heavy frames. Corner brackets 130,130' are used in conjunction with a pair of mounted bracket bodies 10 as hereinabove described. Corner brackets 130,130' are identical in all respects—except that, as illustrated, they are reverse images of each other, one being adapted to fit a frame's upper left-hand corner, and the other being adapted to the upper right-hand corner. Description of one corner bracket 130 accordingly serves to describe the pair.

Corner bracket 130 is fashioned of any sturdy material, and may be composed of metal or injection-molded plastic. Corner bracket 130 has a basically rectangular cross section, and is generally L-shaped with a long leg 136 joined at a right angle with short leg 138. Corner bracket 130 has interior face 132 and exterior face 134. Protruding from long leg 136, near its "free" or distal end and in the same direction as short leg 138, is corner bracket flange 140. Corner bracket flange 140 is a mostly planar web or fin, thinner in cross section than corner bracket 130.

Long leg 136 and short leg 138 are each pierced with at least one corner bracket fastener hole 142,142',142". The openings of the corner bracket fastener holes 142,142',142" are beveled at their openings to permit recessed fastener heads.

Corner brackets 130,130' are used in conjunction with a pair of bodies 10,10'. Two bodies 10,10' are mounted on the wall, using hereinbefore described procedures, near the desired locations of the frame's corners. Ordinarily, mounted bodies 10,10' should be separated by a horizontal distance somewhat less than the width of the frame to be hung. Corner bracket 130 is mounted upon the frame by placing its interior face 132 against the back of the frame. Utilizing the corner bracket fastener holes 142,142', a corner bracket 130 is fastened to the frame at each of its upper corners with nails, screws, or the like. Long leg 136 is fastened to the top section of the frame, while short leg 138 is fastened to the side section of the frame. The frame may then be hung by inserting the corner bracket flanges 140,140' into the bracket recesses 39,39' between bodies 10,10' and the wall.

The apparatuses, and methods for their use, permit a user to quickly, easily, and consistently hang frames horizontally and flush against a wall. Openings in the body grasp nails or other fasteners and hold them in ready position for hammering or screwing, freeing the user's hands to position the apparatus and securely attach it to the vertical mounting surface.

Although the invention has been described with reference to these preferred embodiments, other embodiments can achieve the same results. Variations and modifications of the present invention will be obvious to those skilled in the art and it is intended to cover in the appended claims all such modifications and equivalents. The entire disclosures of all applications, patents, and publications cited above, and of the corresponding application are hereby incorporated by reference.

What is claimed is:

1. An apparatus for installing an object on a surface, comprising:

a combined key and latch system, said key fittable and insertable sideways within said latch for permanently affixing the object to the surface;

said key mountable on the object; and said latch mountable on the surface.

2. The apparatus of claim 1 wherein said key is mounted on the bottom of the object.

3. The apparatus of claim 1 comprising a plurality of key and latch systems mounted in series on the object.

4. The apparatus of claim 1 herein said latch comprises a raised portion indicative of a surface mounting hole for marking the installation location of said latch on the surface prior to installation of said latch on the surface.

5. An apparatus for installing an object on a surface, comprising:

a combined key and latch system, said key fittable and insertable within said latch for permanently affixing the object to the surface;

said key mountable on the object; and said latch comprising of a raised portion indicative of a surface mounting hole for marking the installation location of said latch on the surface prior to installation of said latch on the surface.

6. The apparatus of claim 5 wherein said key is mounted on the bottom of the object.

7. The apparatus of claim 5 comprising of plurality of key and latch systems mounted in series on the object.

8. A method of installing an object on a surface, comprising the steps of:

a) mounting a key on the object;

b) mounting a latch on the surface; and c) sideways inserting the key into the latch for permanently affixing the object to the surface.

9. The method of claim 8 wherein the step of mounting the key on the object comprises mounting the key on a bottom of the object.

10. The method of claim 8 further comprising mounting a plurality keys on the object and a corresponding number of latches on the surface.

11. A method of installing an object on a surface, comprising the steps of:

a) mounting a combined key and latch system on an object, the key portion affixed to the object and the latch portion being removable from the key portion and having a raised portion indicative of a mounting hole;

b) tapping the combined key and latch system against the surface to mark the surface with the raised portion on the latch;

c) mounting the latch system on the surface where indicated by the mark on the surface; and d) insertably fitting the key within the latch to permanently affix the object to the surface.

12. The method of claim 11 wherein the step of insertably fitting the key within the latch comprises sideways inserting the key into the latch.

13. The method of claim 11 wherein the step of mounting a combined key and latch system comprises mounting a plurality of keys on the object a corresponding number of latches on the surface.

14. The method of claim 11 wherein the step of mounting the key on the object comprises mounting the key on a bottom of the object.

* * * * *